US011105230B2

(12) United States Patent
Kim et al.

(10) Patent No.: US 11,105,230 B2
(45) Date of Patent: Aug. 31, 2021

(54) COMPRESSION RELEASE TYPE ENGINE BRAKE AND OPERATING METHOD FOR THE SAME

(71) Applicants: HYUNDAI MOTOR COMPANY, Seoul (KR); KIA MOTORS CORPORATION, Seoul (KR)

(72) Inventors: Kyung Ryull Kim, Seoul (KR); Dong Hyuk Choi, Seoul (KR)

(73) Assignees: Hyundai Motor Company, Seoul (KR); KIA Motors Corporation, Seoul (KR)

( * ) Notice: Subject to any disclaimer, the term of this patent is extended or adjusted under 35 U.S.C. 154(b) by 0 days.

(21) Appl. No.: 16/925,710

(22) Filed: Jul. 10, 2020

(65) Prior Publication Data

US 2021/0095583 A1 Apr. 1, 2021

(30) Foreign Application Priority Data

Sep. 30, 2019 (KR) ..... 10-2019-0120374

(51) Int. Cl.

| | |
|---|---|
| ***F02D 13/04*** | (2006.01) |
| ***F01L 13/06*** | (2006.01) |
| ***F01L 1/18*** | (2006.01) |
| *F01L 9/10* | (2021.01) |

(52) U.S. Cl.

CPC ..... *F01L 13/06* (2013.01); *F01L 1/18* (2013.01); *F01L 9/10* (2021.01); *F01L 2760/003* (2013.01)

(58) Field of Classification Search

CPC ..... F01L 13/06; F01L 1/181; F01L 13/065; F02D 13/04; F02D 9/06

USPC ..... 123/321

See application file for complete search history.

(56) References Cited

U.S. PATENT DOCUMENTS

| | | | | |
|---|---|---|---|---|
| 9,732,642 | B2 * | 8/2017 | Lee | F01L 13/065 |
| 2010/0065019 | A1 * | 3/2010 | Yang | F02D 13/04 123/321 |
| 2011/0023821 | A1 * | 2/2011 | Yoon | F01L 1/181 123/321 |
| 2014/0182536 | A1 * | 7/2014 | Yang | F01L 1/181 123/90.39 |
| 2016/0160711 | A1 * | 6/2016 | Lee | F01L 13/065 123/321 |
| 2018/0087413 | A1 * | 3/2018 | Xi | F01L 13/065 |

* cited by examiner

*Primary Examiner* — Long T Tran
*Assistant Examiner* — James J Kim

(57) ABSTRACT

An compression-release engine brake opens an exhaust valve at an end of a compression stroke for performing braking function. The compression-release engine brake includes: an exhaust cam including a main cam lobe and a brake cam lobe, an exhaust rocker arm including a roller mounted on one end of the exhaust rocker arm contacting or not contacting the exhaust cam and rotating around a rocker arm shaft by rotation of the exhaust cam, a valve bridge disposed at the other end of the exhaust rocker arm and connected with a pair of exhaust valves, and a reset module disposed between the exhaust rocker arm and valve bridge, contacting the roller with the brake cam lobe according to being suppled of engine brake oil, and exhausting the engine brake oil after opening the exhaust valve by rotation of the exhaust cam.

6 Claims, 10 Drawing Sheets

FIG. 10 "PRIOR ART"
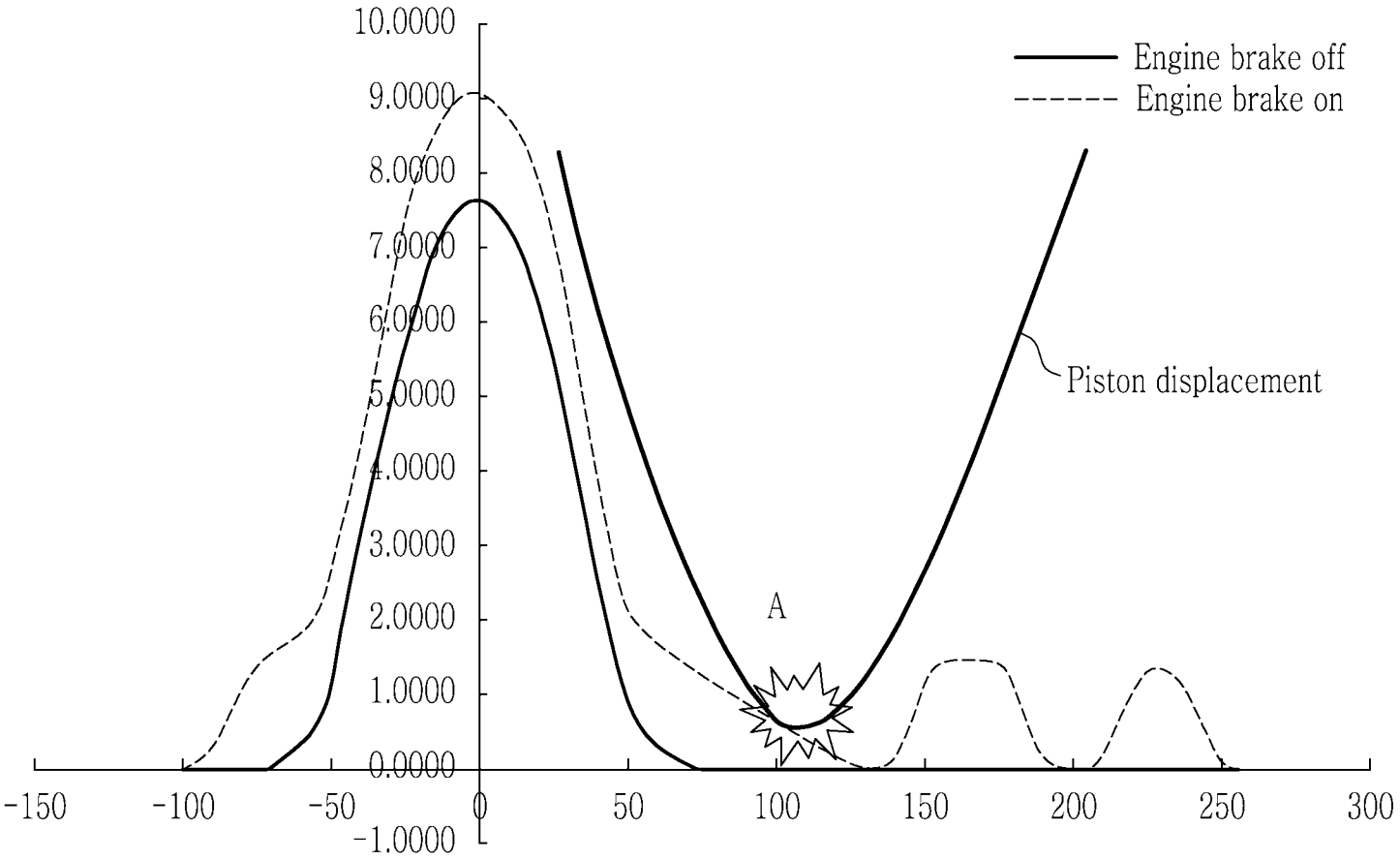

COMPRESSION RELEASE TYPE ENGINE BRAKE AND OPERATING METHOD FOR THE SAME

CROSS-REFERENCE TO RELATED APPLICATION

This application claims priority to and the benefit of Korean Patent Application No. 10-2019-0120374, filed on Sep. 30, 2019, the entire contents of which are incorporated herein by reference.

FIELD

The present disclosure relates to a compression-release engine brake, and an operation method of the engine brake using the same.

BACKGROUND

The statements in this section merely provide background information related to the present disclosure and may not constitute prior art.

In general, a brake system of an internal combustion engine vehicle uses a hydraulic pressure type of brake, but the engine brake is used to prevent premature abrasion of a brake pad during downhill driving or frequent sudden stops.

The compression-release engine brake device (namely, compression-release engine brake), which is a type of engine brake, temporarily opens an exhaust valve near a compress top dead center of a piston during the basic four strokes of the engine, i.e., exhausts compressed air in a cylinder out of the cylinder to thereby obtain a braking effect by inducing a pumping loss of an expansion stroke.

In a compression-release engine brake according to a conventional art, a socket module is applied between a valve bridge connected with a pair of exhaust valves, and an exhaust rocket arm.

In the socket module, the brake piston is provided inside the housing where the brake oil is introduced, and when the engine brake is operated, the brake piston moves downward to eliminate the gap between the exhaust rocker arm and the exhaust cam, thereby forcing the exhaust valve to be opened at the end of the compression stroke.

The exhaust valve is opened at the end of the compression stroke by the socket module to add braking force to the vehicle, but once the engine brake oil is introduced into the socket module, it is not exhausted, and thus the valve may be opened more by oil pressure formed in the socket module.

FIG. 10 is a graph that shows a valve lift displacement amount occurring in use of a compression-release engine brake according to a conventional art.

As shown in FIG. 10, there is a possibility of occurrence of a contact A between an exhaust valve and an engine piston.

In order to solve such a problem, meanwhile, a compression-release engine brake with a reset bracket is provided on one side of the socket module. However, the reset bracket must be applied to the outside of the reset module and thus there is a drawback in which the overall size is increased.

The above information disclosed in this Background section is only for enhancement of understanding of the background of the present disclosure, and therefore it may contain information that does not form the prior art that is already known to a person of ordinary skill in the art.

SUMMARY

An exemplary form of the present disclosure provides a compression-release engine brake that can automatically initialize a pressure inside a socket module by automatically exhausting the engine brake oil that has been introduced into the socket module during engine brake operation, and an operation method for the engine brake.

In one form of the present disclosure, an compression-release engine brake opening an exhaust valve at an end of a compression stroke for performing braking function, the compression-release engine brake may include: an exhaust cam including a main cam lobe and a brake cam lobe; an exhaust rocker arm including a roller mounted on a first end of the exhaust rocker arm configured to selectively contact with the exhaust cam, where the exhaust rocker arm rotates around a rocker arm shaft by rotation of the exhaust cam; a valve bridge disposed at a second end of the exhaust rocker arm and connected with a pair of exhaust valves; and a reset module disposed between the exhaust rocker arm and the valve bridge, where the reset module is configured to cause the roller to contact with the brake cam lobe when engine brake oil is supplied to the reset module and can exhaust the engine brake oil after opening the exhaust valve by rotation of the exhaust cam.

The reset module may include: a housing that includes an inlet through which the engine brake oil flows in through an adjusting screw fastened to the second end of the exhaust rocker arm, and an outlet through which the engine brake oil is discharged; a check valve installed inside the housing to open and close the inlet of the housing, a reset piston disposed inside the housing, configured to slide in an up and down direction and connected to the exhaust valve, and a reset pin inserted inside the housing to open and close the outlet.

The housing may include: a mounting portion that is protruded upward and has a rounded groove to fit into the lower end of the adjusting screw; a first portion forming a first space arranged downward of the mounting portion, where the first space is configured to fluidly communicate with the inlet through which the engine brake oil flows; a reset piston adapting portion having a diameter which is smaller than a diameter of the first space, where the reset piston adapting portion is continuously connected with the first portion through a stepped portion, and a lower portion of the reset piston adapting portion is opened to which the reset piston is disposed; and a second space communicated with the first space, formed in a vertical direction across an outlet where the engine brake oil is exhausted, with each end of the up and down direction open, and of which the reset pin is inserted.

The check valve may be configured to open and close the inlet while moving in an up and down direction and elastically supported by a check spring that is accommodated through a valve groove formed on an upper surface of the reset piston and fitted to a protruded portion protruded in a central portion of the valve groove.

The reset piston may include an upper portion disposed in the first space, and a circular clip is inserted into a clip groove formed on the upper portion of the reset piston and configured to inhibit the upper portion from traveling below the stepped portion.

The reset pin includes a closed top portion, and an open bottom portion and is configured to form a hollow inside and move through the second space in the up and down direction while supported by a reset spring inserted inside.

Movements of the reset pin may be limited by both retainers mounted on both ends of the up and down direction of the second space.

The retainers of which protrusions are formed along interior surface thereof may be inserted into inserting grooves formed both ends of the up and down direction of the second space.

In another form, a method for operating the compression-release engine brake may include: a first step in which engine brake oil is introduced though an inlet of a housing of the reset module to a first space formed inside of the housing, a second step in which the reset piston descends by the engine brake oil and thus the exhaust rocker arm rotates in a first direction relative to the rocker arm shaft such that the roller and the exhaust cam contact each other, a third step in which the brake cam lobe rotates and thus the exhaust rocker arm presses the valve bridge while rotating in a second direction relative to the rocker arm shaft such that the exhaust valve is opened, and a fourth step in which a reset pin blocking the outlet formed in the housing is moved so that the engine brake oil is exhausted according to the operation of the up and down direction of the exhaust valve.

The first step may include introducing the engine brake from an adjusting screw engaged to the other end of the exhaust rocker arm, and inflowing the engine brake oil to a first space of the housing through the inlet while a check valve is opened, which is installed inside the housing to open and close the inlet of the housing.

The second step may include closing the inlet while the check valve is raised by the restoring force of the check spring that elastically supports the check valve, and the reset piston descending, and supporting the reset piston by the valve bridge such that the housing is lifted, and the roller and the exhaust cam contact each other while the exhaust rocker arm rotates in the first direction relative to the rocker arm shaft.

In the third step, the exhaust rocker arm may rotate in the second direction in a section where the brake cam lobe and the roller contact each other while the exhaust cam rotates, and the exhaust valve connected to the valve bridge may be opened while the valve bridge is pressed in a downward direction.

In the fourth step, the reset pin may be lowered relatively by the inertia force of the reset pin while the exhaust valve moves up and down directions, the outlet may be opened as the reset pit is lowered, and the engine brake oil may be exhausted through the outlet.

After the fourth step, the brake oil may be discharged, the reset piston may move upward and the reset pin may be returned to an initial position.

The compression-release engine brake according to an exemplary form of the present disclosure and the engine brake operation method for the same automatically exhaust the brake oil introduced into the housing during engine brake operation such that It is possible to prevent the exhaust valve from contacting the engine piston.

In addition, effects obtained or predicted by the exemplary form of the present disclosure are disclosed directly or implicitly in a detailed description of an exemplary form of the present disclosure. That is, various effects predicted according to an exemplary form of the present disclosure will be disclosed in a detailed description to be described later.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
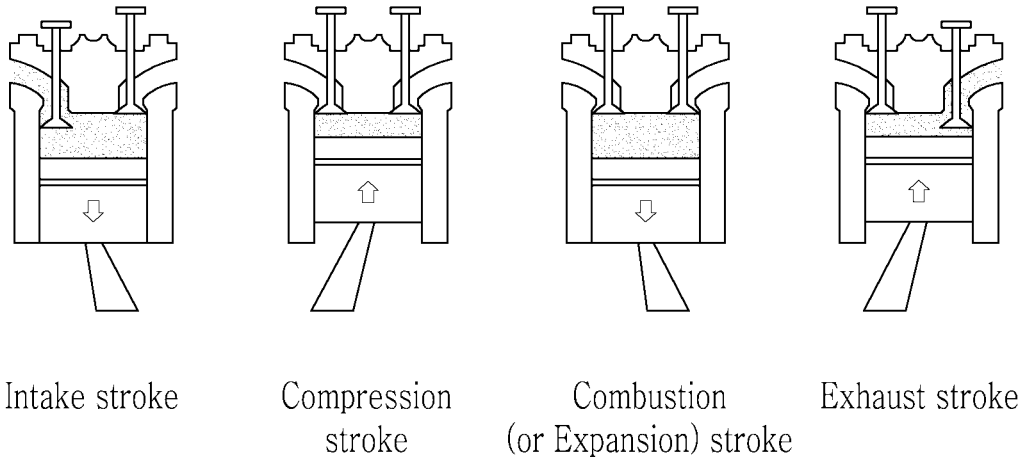
FIG. 1 is a schematic diagram of a basic four-stroke cycle of an engine.

FIG. 6 to FIG. 9 sequentially illustrate an operation of the compression release type engine brake; and FIG. 10 is a graph that shows a valve lift displacement amount occurring in use of a general compression-release engine brake.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure will be described more fully hereinafter with reference to the accompanying drawings, in which exemplary forms of the present disclosure are shown. As those skilled in the art would realize, the described forms may be modified in various different ways, all without departing from the spirit or scope of the present disclosure.

In the following description, dividing names of components into first, second, and the like is to divide the names because the names of the components are the same as each other, and an order thereof is not particularly limited.

Figure 2:
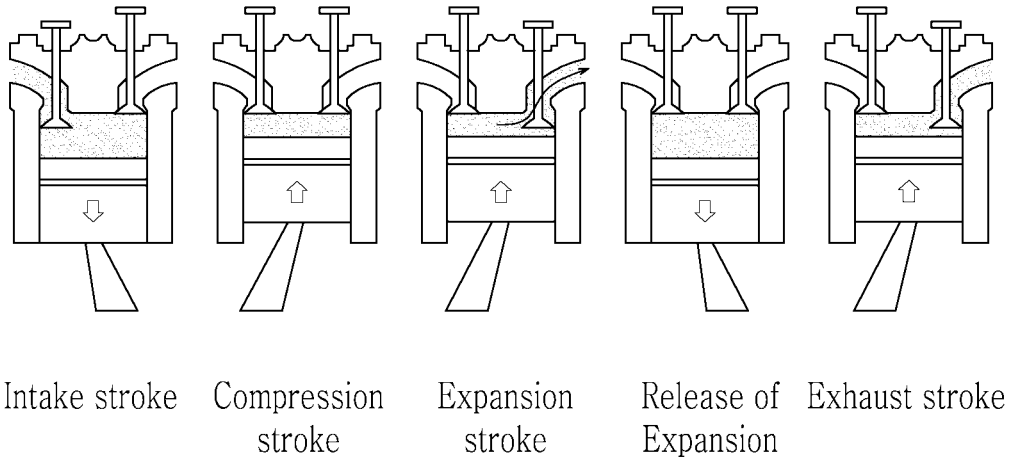
FIG. 2 is a schematic diagram of an engine cycle for description of a compression-release engine brake.

FIG. 1 is a schematic diagram of a basic four-stroke cycle of an angle, and FIG. 2 is a schematic diagram of an engine cycle for description of a compression-release engine brake according to an exemplary form of the present disclosure.

In general, the engine brake may be applied to prevent the vehicle from causing premature wear of the brake pads applied to the foot brake when driving downhill or when frequently stopping suddenly.

The compression-release engine brake is actuated in one of the four basic strokes of the engine, and opens an exhaust valve at the end of a compression stroke so that the engine can perform its braking function.

Referring to FIG. 1, a vehicle engine is driven by repeating a four-stroke cycle of intake, compression, combustion, and exhaust when driving.

As shown in FIG. 2, the compression-release engine brake temporarily opens an exhaust valve at the end of the compression stroke, that is, near a top dead center of the piston, to exhaust compressed air in a cylinder to the outside the cylinder, thereby acquiring a braking effect by inducing a pumping loss in the expansion stroke.

For this, the compression-release engine brake according to the exemplary form of the present disclosure may be formed as follows.

Figure 3:
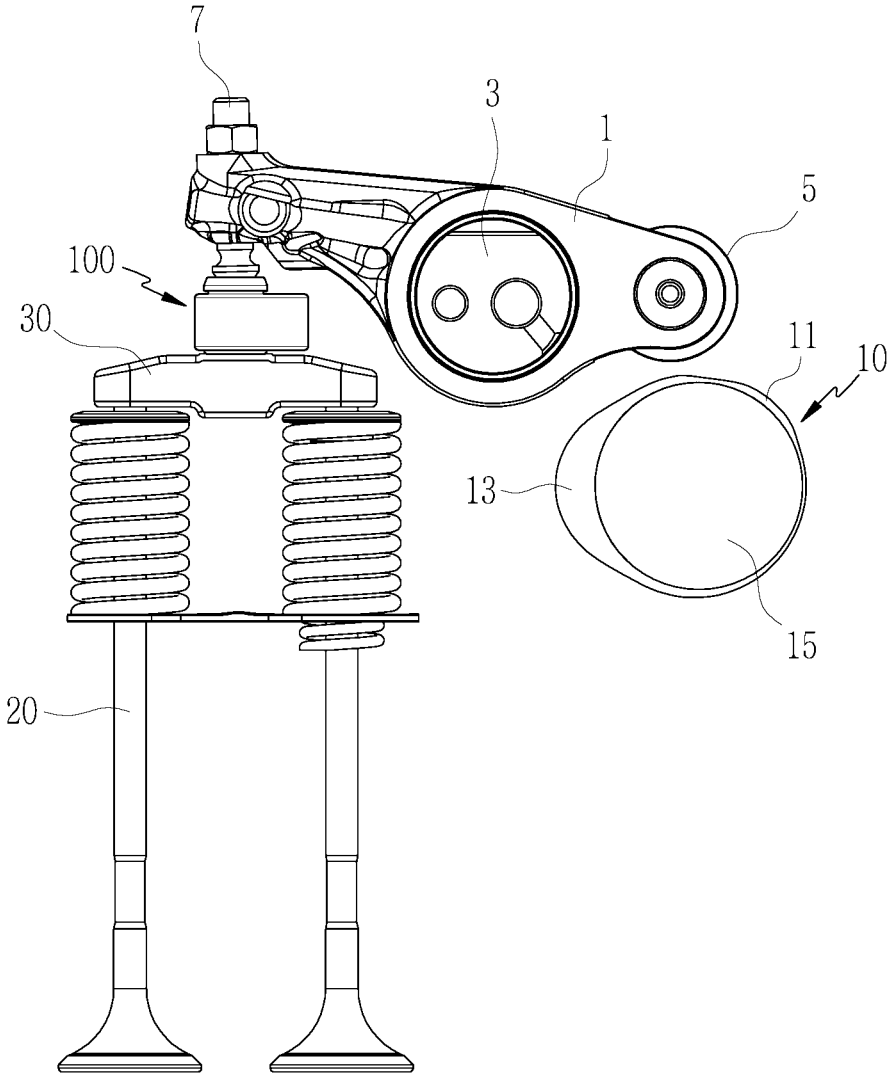
FIG. 3 is a schematic diagram of the compression-release engine brake.

FIG. 3 is a schematic diagram of the compression-release engine brake according to an exemplary form of the present disclosure.

Referring to FIG. 3, in the compression release type engine brake, a rocker arm shaft 3 is inserted into an exhaust rocker arm 1 such that the exhaust rocker arm 1 rotates with respect to the rocker arm shaft 3, a roller 5 is mounted to one end of the exhaust rocker arm 1, and an adjusting screw 7 is mounted to the other end of the exhaust rocker arm 1.

The roller 5 is formed to contact or not contact an exhaust cam 20 installed on a camshaft.

The adjusting screw 7 is mounted to the other end of the exhaust rocker arm 1 and is thus connected with a valve bridge 30 through a rest module 100 provided at a lower end thereof.

The valve bridge 30 is connected to the exhaust valve 20, and the exhaust valve 20 may be provided as a pair.

In addition, the exhaust cam 10 may be divided into a brake cam lobe section and a main cam lobe section according to a profile, and the brake cam lobe section and the main cam lobe section may be implemented by forming a brake cam lobe 11 and a main cam lobe 13 on the exhaust cam shaft 15.

The main cam lobe 13 may implement the exhaust stroke by contacting the roller 5, and the brake cam lobe 11 may open the exhaust valve 20 by contacting the roller 5 when the engine brake is operated.

In addition, a bias spring (not shown) is mounted to the exhaust rocker arm 1, and the bias spring lifts one end of the exhaust rocket arm 1, which corresponds to the roller 5, and the same time, provides an elastic force in a direction in which the other end of the exhaust rocker arm 1, which corresponds to the adjusting screw 7, to be closely attached to the valve bridge 30.

Accordingly, in a state before the engine brake operation (in the basic engine stroke), the roller 5 maintains a distance with the brake cam lobe 11 of the exhaust cam 10, and, in the exhaust stroke, the roller 5 is pushed upward only by the main cam lobe 13 of the exhaust cam 10.

That is, when brake oil for operation of the engine brake is not supplied, a gap is formed between the roller 5 provided at the other end of the exhaust rocker arm 1 and the exhaust cam 10 and thus the brake cam lobe 11 of the exhaust cam 10 and the roller 5 do not contact each other, thereby causing the engine brake not to work.

On the other hand, when the engine brake oil is supplied to operate the engine brake, the reset module 100 lifts the other side of the exhaust rocker arm 1 up such that the roller 5 and the exhaust cam 10 are in constant contact, and thus, at the end of the compression stroke, the exhaust rocker arm 1 is operated by the brake cam lobe 11 of the exhaust cam 10, so that the braking effect can be obtained.

The reset module 100 is applied between the exhaust rocker arm 1 and the valve bridge 30.

Figure 4:
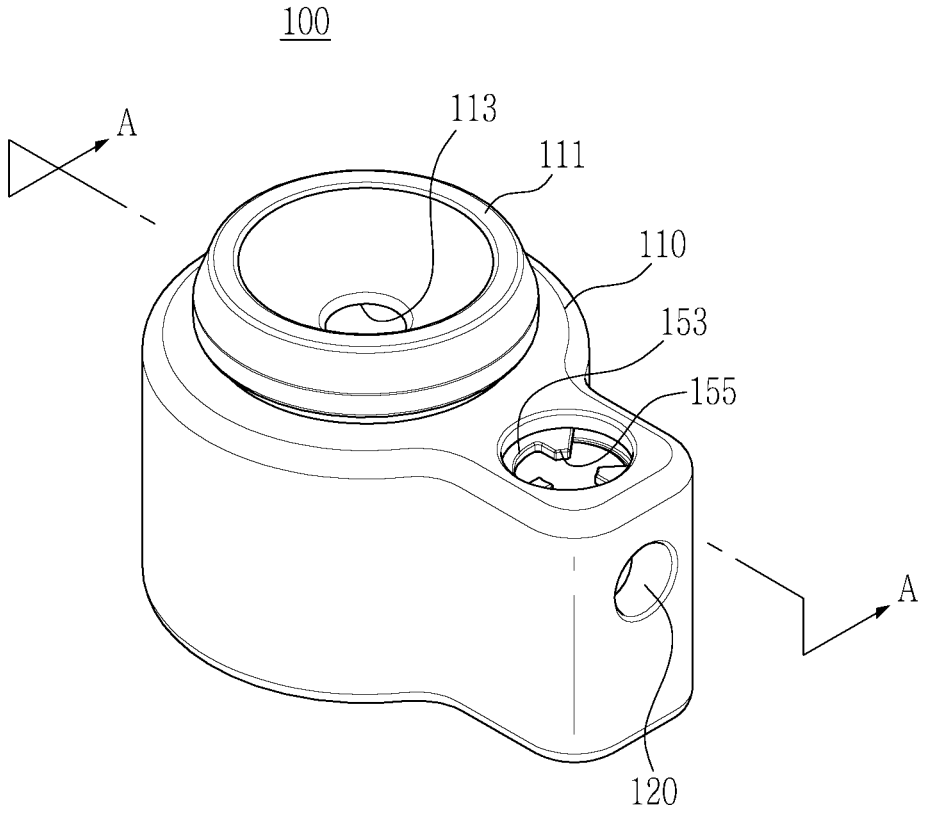
FIG. 4 is a perspective view of the socket module applied to the compression-release engine brake.
Figure 5:
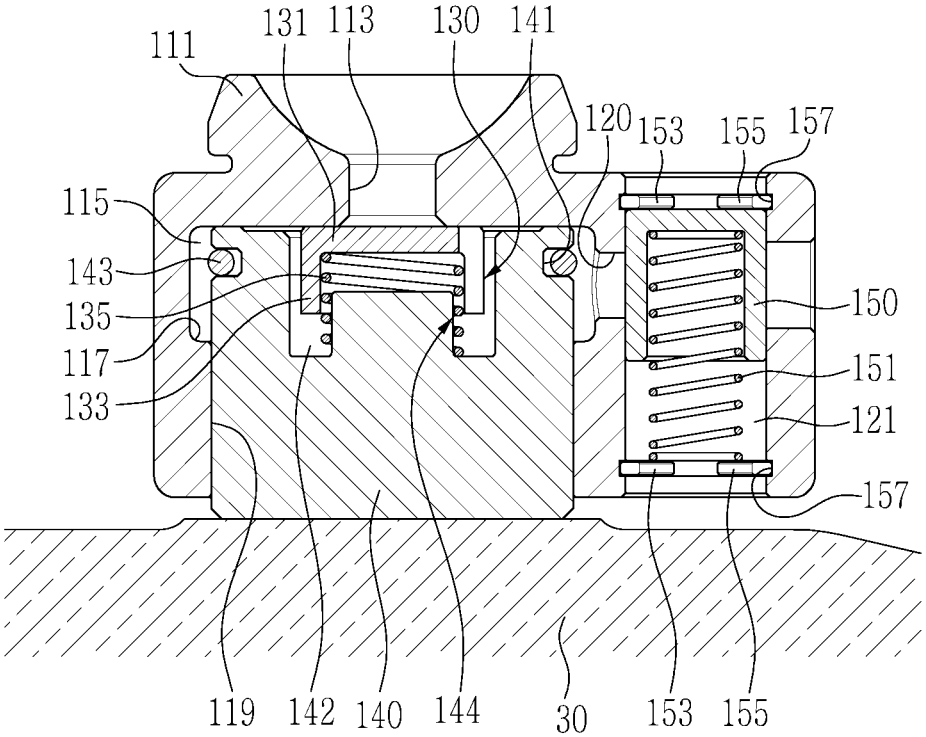
FIG. 5 is a cross-sectional view of FIG. 4, taken along the line A-A.

FIG. 4 is a perspective view of the socket module of the compression-release engine brake according to an exemplary form of the present disclosure, and FIG. 5 is a cross-sectional view of FIG. 4, taken along the line A-A.

Referring to FIG. 4 to FIG. 5, the reset module 100 of the compression-release engine brake includes a housing 110, a check valve 130, a reset piston 140, and a reset pin 150.

The housing 110 includes a mounting portion 41 that protrudes upward from a center of an upper center thereof for fitting an lower end of the adjusting screw 7.

Spaces communicated with the mounting portion 111 are formed inside of the housing 110.

That is, in the housing 110, an inlet 113 is formed in the center of the mounting portion 111, and a first space 115 connected to the inlet 113 is formed below the inlet 113.

In addition, the housing 110 includes a reset piston adapting portion 119, and a first portion forming the first space 115. The first portion forming the first space 115 is continuously connected with the reset piston adapting portion 119 through a stepped portion 117. The reset piston adapting portion 119 has a smaller diameter than that of the first space 115.

The reset piston adapting portion 119 opens the lower portion, through which the reset piston 140 is movably fitted in the up and down direction.

An outlet 120 is formed to be connected to the first space 115 so that the engine brake oil is exhausted.

The outlet 120 is configured to open and close by the second space 121, the second space 121 may be formed in the vertical direction of the outlet 120.

Each end in the up and down direction of the second space 121 is open to the outside.

The check valve 130 is mounted inside the housing 110 to open and close the inlet 113.

The check valve 130 includes an upper plate 131 in contact with the inlet 113 and legs 133 formed below the upper plate 131. The leg 133 may be formed as a plurality of spaced apart at regular intervals along the circumference of the upper plate 131.

The check valve 130 is accommodated in a valve groove 142 formed on the reset piston 140.

The check valve 130 is elastically supported by a check spring 135.

The check spring 135 has one end fitted to the protruded portion 144 protruded in the central portion of the upper surface of the reset piston 140, and the other end supports the upper plate 131 of the check valve 130.

And the reset piston 140 is inserted into the reset piston adapting portion 119 of the housing 110 and is slidably mounted in the up and down direction.

On the reset piston 140, a clip groove 141 is formed on the upper exterior surface (e.g., an exterior surface of an upper portion) of the reset piston 140, the upper portion is disposed in the first space 115, and a circular clip 143 is fitted on the clip groove 141. With this arrangement, the circular clip 143 inhibits or prevents the upper portion of the reset piston 140 from traveling (e.g., falling) below the stepped portion 117.

The reset piston 140 is configured to be caught in the stepped portion 117 between the first space 115 and the reset piston adapting portion 119 by the circular clip 143 so as not to fall downward.

The circular clip 143 inhibits or prevents the reset piston 140 from falling out of the housing 110 when the reset module 100 is moved or mounted.

The reset pin 150 is mounted on the second space 121 of the housing 110, and the reset pin 150 serves to open and close the outlet 120 along the second space 121 in the up and down direction.

The reset pin 150 is formed in a cylinder shape and includes a closed top portion and an open bottom portion, forming a hollow inside.

The reset pin 150 is elastically supported by a reset spring 151 inserted inside the hollow.

The reset pin 150 is limited in position through both retainers 153 mounted on both ends of the up and down directions of the second space 121.

The retainer 153 on both sides is formed as a ring shape, and one side may be incised.

When the retainer 153 on both sides is mounted on the housing 110, it can be easily mounted in a closed state through an incision.

These retainers 153 may be mounted through inserting grooves 157 formed on both circumferences corresponding to the second space 121 of the housing 110, respectively.

In addition, the retainer 153 has a protrusion (155; referring to FIG. 4) protruded toward the center at regular intervals along the interior surface.

The upper retainer 153 is in contact with the reset pin 150, the engine brake oil may be discharged therethrough, and the lower retainer 153 is equipped with the reset spring 151.

Operations of the compression-release engine brake according to an exemplary form of the present disclosure will be described as follows.

FIG. 6 to FIG. 9 sequentially illustrate an operation of the compression release type engine brake according to an exemplary form of the present disclosure.

Figure 6:
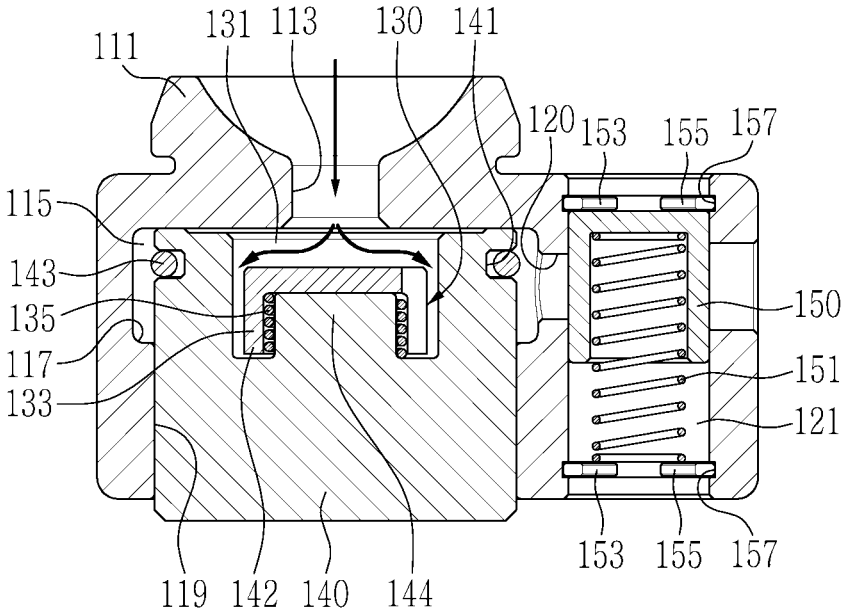

Referring to FIG. 6, when the engine brake is operated, the engine brake oil flows through the flow path inside the adjusting screw 7 to the inlet 113 of the housing 110.

At this time, the check valve 130 closing the inlet 113 opens, and the engine brake oil flows into the first space 115 of the housing 110.

Figure 7A:
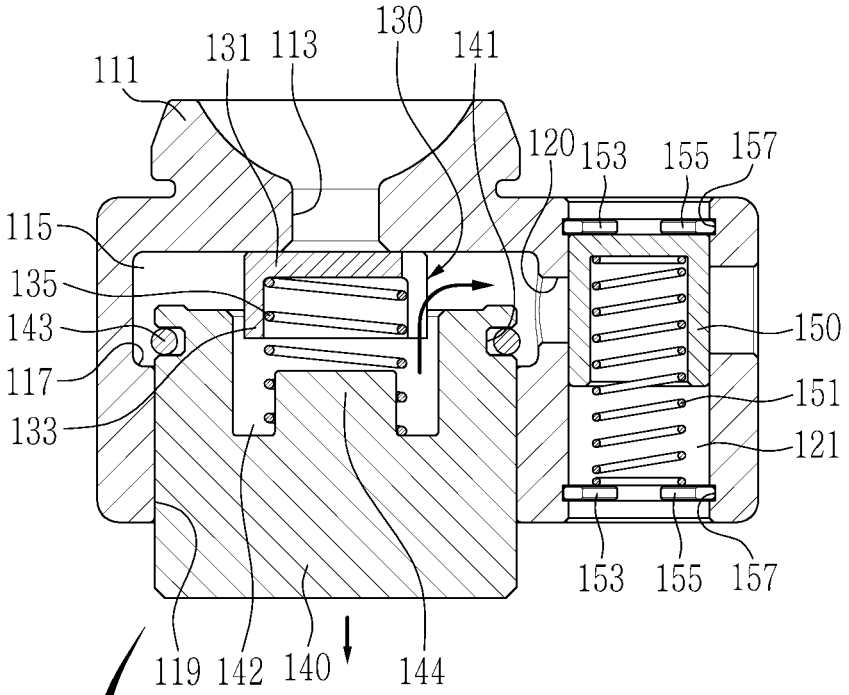
Figure 7B:
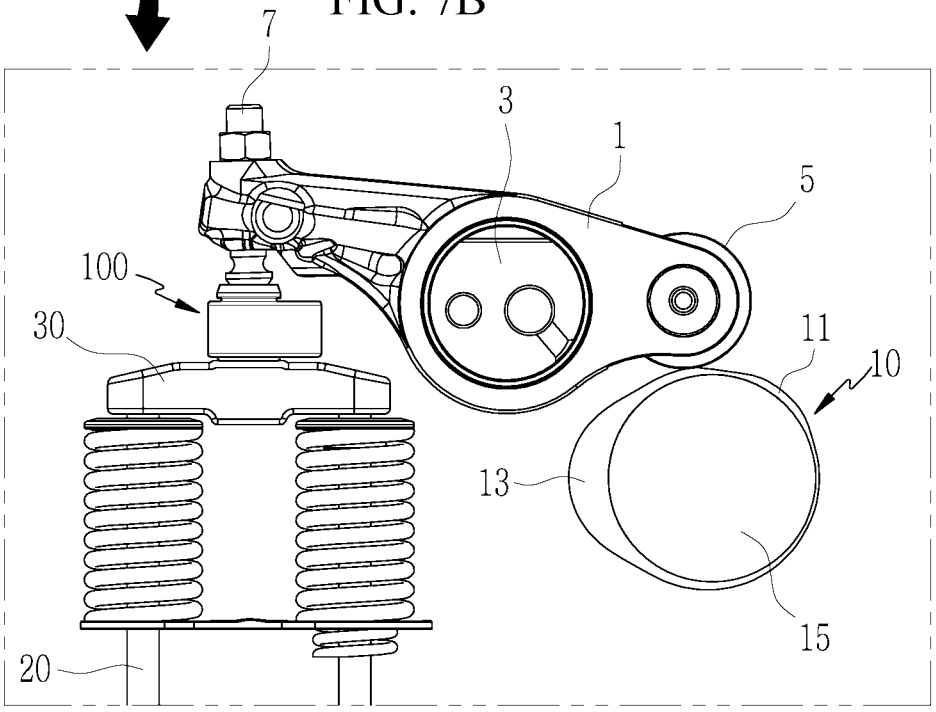

Referring to FIGS. 7A and 7B, when the engine brake oil flows into the first space 115, the reset piston 140 descends by the hydraulic pressure, and the check valve 130 closes the inlet 113 and seal the first space 115.

As the reset piston 140 descends, the overall length of the up and down direction of the reset module 100 becomes longer, so that the end corresponding to the reset module 100 of the exhaust rocker arm 1 is pushed upwards and the exhaust rocker arm 1 is rotated with respect to the rocker arm shaft 3.

Subsequently, the roller 5 of the exhaust rocker arm 1 and the exhaust cam 10 contact.

When the exhaust cam 10 rotates and contacts the roller 5 in the brake cam lobe section of the exhaust cam 10, the end corresponding to roller 5 of the exhaust rocker arm 1 is pushed upward by the protruded brake cam lobe 11. So that the exhaust rocker arm 1 rotates with respect to the rocker arm shaft 3.

Due to this operation, when the reset piston 140 presses the valve bridge 30 downward, the exhaust valve 20 is opened. At the end of the compress stroke, that is, the exhaust valve 20 is temporarily opened near the top dead center to exhaust the compressed air in the cylinder out of the cylinder, thereby inducing a pumping loss of the expansion stroke to obtain a braking effect.

Figure 8:
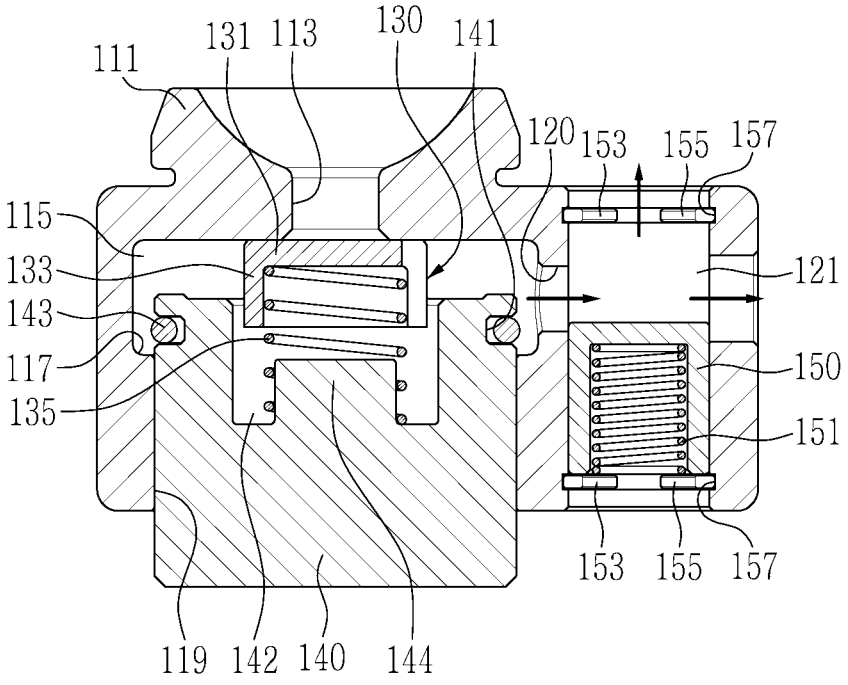

Referring to FIG. 8, since the inertial force acts on the reset pin 150 simultaneously with the movement of the exhaust valve 20, the reset spring 151 is compressed by the inertia force of the reset pin 150, and the reset pin 150 moves relative to the lower side.

Accordingly, the outlet 120 is opened and the engine brake oil stored in the first space 115 is exhausted through the outlet 120 and the second space 121.

Figure 9:
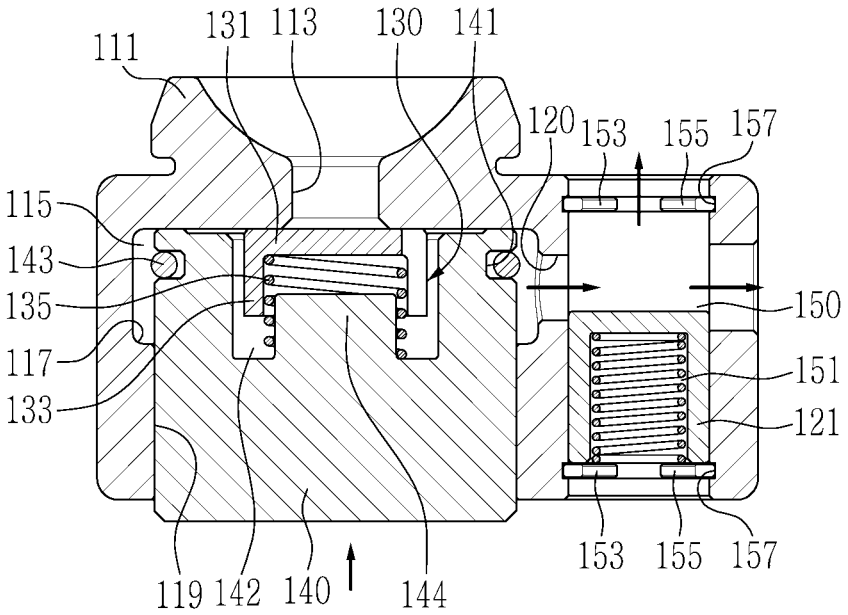

Referring to FIG. 9, when the engine brake oil is completely exhausted inside the housing 110, reset piston 140 moves upward, the reset pin 150 is returned to the initial state by restoring force of the reset spring 151, and the gap as shown in FIG. 3 is maintained between the roller 5 and exhaust cam 10.

Therefore, according to an exemplary form of the present disclosure, the compression-release engine brake and method for the same automatically exhaust the engine brake oil flowing into the reset module 100 when the engine brake is operated, so that it is possible to prevent the exhaust valve 20 from contacting the engine piston.

According to an exemplary form of the present disclosure, by separately configuring the reset piston adapting portion 119 on which the reset piston 140 is mounted and the first space 115 on which the engine brake oil is inflow, the oil supply path can be shortened or minimized to improve the oil sealing property, thereby improving reactivity.

In addition, according to an exemplary form of the present disclosure, by using the inertia force of the reset pin 150 to exhaust the engine brake oil with a simple structure without a separate device, it is possible to reduce the cost by reducing the number of parts and weight.

While this present disclosure has been described in connection with what is presently considered to be practical exemplary forms, it is to be understood that the present disclosure is not limited to the disclosed forms. On the contrary, it is intended to cover various modifications and equivalent arrangements included within the spirit and scope of the present disclosure.

<Description of symbols>

| | |
|---|---|
| 1: exhaust rocker arm | 3: rocker arm shaft |
| 5: roller | 7: adjusting screw |
| 10: exhaust cam | 11: brake cam lobe |
| 13: main cam lobe | 15: camshaft |
| 20: exhaust valve | 30: valve bridge |
| 100: reset module | 110: housing |
| 111: mounting portion | 113: inlet |
| 115: first space | 117: stepped portion |
| 119: reset piston adapting portion | 120: outlet |
| 121: second space | 130: check valve |
| 131: upper plate | 133: leg |
| 135: check spring | 140: reset piston |
| 141: clip groove | 142: valve groove |
| 143: circular clip | 150: reset pin |
| 151: reset spring | 153: retainer |
| 155: protrusion | 157: inserting groove. |

What is claimed is:

1. An compression-release engine brake for opening an exhaust valve at an end of a compression stroke of an engine, the compression-release engine brake comprising:

an exhaust cam including a main cam lobe and a brake cam lobe;

an exhaust rocker arm including a roller mounted on a first end of the exhaust rocker arm configured to selectively contact with the exhaust cam, the exhaust rocker arm configured to rotate around a rocker arm shaft by rotation of the exhaust cam;

a valve bridge disposed at a second end of the exhaust rocker arm and connected with a pair of exhaust valves; and a reset module disposed between the exhaust rocker arm and the valve bridge, wherein the reset module is configured to cause the roller to contact with the brake cam lobe when engine brake oil is supplied to the reset module, and configured to discharge the engine brake oil after opening the exhaust valve by rotation of the exhaust cam, wherein the reset module comprises:

a housing including: an inlet through which the engine brake oil flows in through an adjusting screw fastened to the second end of the exhaust rocker arm, and an outlet through which the engine brake oil is discharged;

a check valve installed inside the housing and configured to open and close the inlet of the housing;

a reset piston disposed inside the housing and configured to slide in an up and down direction; and a reset pin inserted inside the housing and configured to open and close the outlet, and wherein the housing comprises:

a mounting portion that is protruded upward and has a rounded groove to fit into a lower end of the adjusting screw;

a first portion forming a first space arranged downward of the mounting portion, where the first space is configured to fluidly communicate with the inlet through which the engine brake oil flows;

a reset piston adapting portion having a diameter which is smaller than a diameter of the first space, where the reset piston adapting portion is continuously connected with the first portion through a stepped portion, wherein a lower portion of the reset piston adapting portion is opened toward the reset piston; and a second space communicated with the first space, formed in a vertical direction across an outlet where the engine brake oil is exhausted, with each end of the up and down direction open, and of which the reset pin is inserted.

2. The compression-release engine brake of claim 1, wherein the check valve is configured to open and close the inlet while moving in an up and down direction and elastically supported by a check spring that is accommodated through a valve groove formed on an upper surface of the reset piston and fitted to a protruded portion protruded from a central portion of the valve groove.

3. The compression-release engine brake of claim 1, wherein the reset piston includes an upper portion disposed in the first space, and a circular clip is inserted into a clip groove formed on the upper portion of the reset piston and configured to inhibit the upper portion from traveling below the stepped portion.

4. The compression-release engine brake of claim 1, wherein the reset pin includes a closed top portion, and an open bottom portion and is configured to form a hollow inside and move in the second space in the up and down direction while supported by a reset spring.

5. The compression-release engine brake of claim 1, wherein movements of the reset pin are limited by retainers respectively mounted on both ends of the up and down direction of the second space.

6. The compression-release engine brake of claim 5, wherein retainers include protrusions formed along an interior surface of respective retainers and are inserted into inserting grooves formed both ends of the up and down direction of the second space.

* * * * *